US006460464B1

(12) United States Patent
Attarwala

(10) Patent No.: US 6,460,464 B1
(45) Date of Patent: Oct. 8, 2002

(54) ADHESIVE FOR RING SEAL IN CENTER FIRE AMMUNITION

(75) Inventor: Shabbir Attarwala, Simsbury, CT (US)

(73) Assignee: Henkel Loctite Corporation, Rocky Hill, CT (US)

( * ) Notice: Subject to any disclaimer, the term of this patent is extended or adjusted under 35 U.S.C. 154(b) by 0 days.

(21) Appl. No.: 09/612,493

(22) Filed: Jul. 7, 2000

Related U.S. Application Data

(60) Provisional application No. 60/144,484, filed on Jul. 19, 1999.

(51) Int. Cl.[7] ..... F42B 5/26; C09J 101/00

(52) U.S. Cl. ..... 102/469; 102/470; 156/331.1

(58) Field of Search ..... 102/469, 470, 102/398; 29/1.3, 1.31, 1.32; 86/1.11; 156/325, 326, 331.1, 331.8, 272.2, 275.5, 275.7

(56) References Cited

U.S. PATENT DOCUMENTS 1,879,278 A * 9/1932 Jacobs
3,046,262 A * 7/1962 Krieble
3,218,305 A * 11/1965 Krieble
3,428,614 A * 2/1969 Brownstein
3,847,081 A * 11/1974 Quinlan et al.
3,855,040 A * 12/1974 Malofsky
4,080,238 A * 3/1978 Wolinski et al.
4,287,330 A * 9/1981 Rich
4,533,446 A 8/1985 Conway ..... 204/159.24
5,639,986 A * 6/1997 Evans
6,090,453 A * 7/2000 Narang et al.
6,231,714 B1 * 5/2001 Woods et al.

FOREIGN PATENT DOCUMENTS

JP 05-105847 4/1993 ..... C09J/4/02

* cited by examiner

*Primary Examiner*—Charles T. Jordan
*Assistant Examiner*—Aileen J. Baker
(74) *Attorney, Agent, or Firm*—Steven C. Bauman

(57) ABSTRACT

The present invention provides UV/anaerobic dual cure adhesives, particularly well-suited for sealing the ring around the primer cup in center fire ammunition by UV cure and the primer cup in the cartridge by anaerobic cure.

16 Claims, 1 Drawing Sheet

ADHESIVE FOR RING SEAL IN CENTER FIRE AMMUNITION

This application claims the benefit of Provisional Application No. 60/144,484, filed Jul. 19, 1999.

BACKGROUND OF THE INVENTION

1. Field of the Invention

This invention relates to an adhesive for sealing the primer cup ring in center fire ammunition.

2. Brief Description of Related Technology

Anaerobic adhesives are known, as are anaerobic adhesives having a secondary cure mechanism, such as ultraviolet curing. Such adhesives are widely used commercially. Nonetheless, certain commercial applications have proven troublesome for those anaerobic adhesives and UV/anaerobic dual cure adhesives.

For instance, in one such commercial application, ring sealing the primer cup in the cartridge of center fire ammunition, plasticizers are used in the adhesive to provide a flexible adhesive joint at the ring seal to absorb trigger impact. In this application, the primer cup, when inserted into the cartridge case, cures by virtue of the anaerobic cure mechanism. The seal around the primer cup, which is exposed to the atmosphere, is cured by irradiation with UV light. The sealing function is to prevent the ingress of atmospheric or other moisture into the primer cup that is filled with a lead-free organic compound, but tends to be hygroscopic in nature. A primer seating defect can result in the misfiring of a gun.

However, these plasticizers tend to leach out of the adhesive bond leaving a sticky residue on the ammunition cartridge surface. With UV/anaerobic dual cure products, plasticizers used may become entrapped and thus do not leave a sticky surface. In addition, the integrity of the ring seal may become compromised leading to failure and separation from the ammunition cartridge surface. This is problematic after ammunition is fired as the gun barrel may become clogged.

Radiation curable anaerobic adhesive compositions are known. For instance, U.S. Pat. No. 4,533,446 (Conway) is directed to such a composition that includes an anaerobically curable monomer, cationic photoinitiator, a peroxide and a ferrocence-based anaerobic polymerization initiator. However, in practice, these compositions have poor pot life since the metal ion in the ferrocene compound acts to initiate anaerobic cure.

It would be desirable to provide an anaerobic adhesive, which may or may not cure through a secondary mechanism, that does not suffer from these recognized shortcomings.

SUMMARY OF THE INVENTION

The present invention provides UV/anaerobic dual cure adhesives, particularly well-suited for sealing the ring around the primer cup (i.e., the primer cup/primer pocket interface) in center fire ammunition by UV cure and the primer cup in the cartridge by anaerobic cure.

More specifically, the adhesives include a (meth)acrylate component, at least a portion of which is a monofunctional (meth)acrylate; an anaerobic cure-inducing component; and a photoinitiator component, where the monofunctional (meth)acrylate is present in an amount in the range of about 10 to about 25% by weight of the total composition. The adhesives may also include a plasticizer component in an amount less than about 20% by weight of the total composition.

The invention is also directed to a method of making such compositions, as well as a method of using them. For instance, the invention provides a method of using the compositions in the assembly of ammunition, such as the primer sealer.

In addition, the invention provides cured reaction products of these compositions.

DETAILED DESCRIPTION OF THE INVENTION

Figure 1:
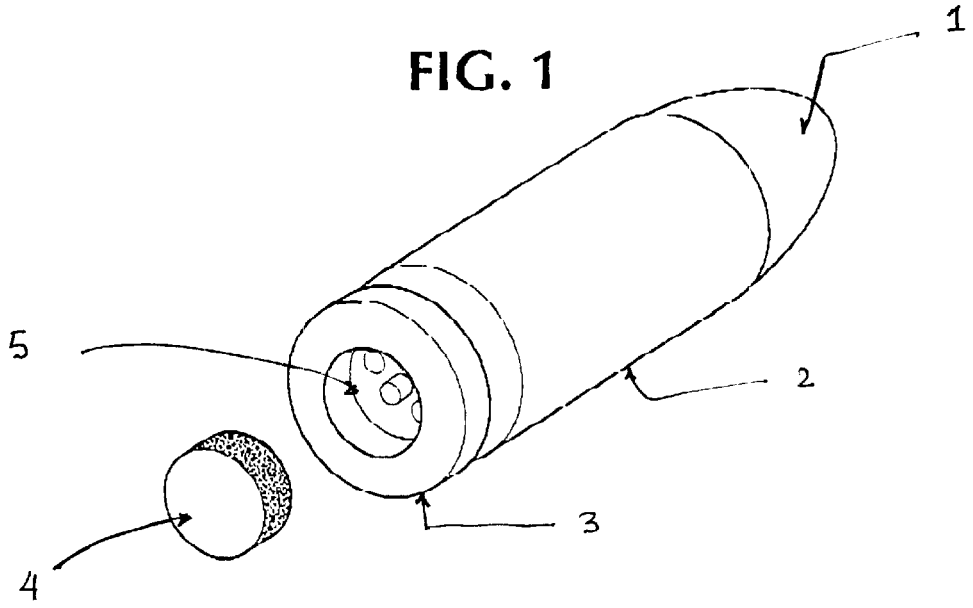
FIG. 1 depicts an exploded perspective view of a cartride assembled using the inventive composition.

As noted above, the inventive adhesives include a (meth) acrylate component, at least a portion of which is a monofunctional (meth)acrylate; an anaerobic cure-inducing composition; and a photoinitiator component, where the monofunctional (meth)acrylate is present in an amount in the range of about 10 to about 25% by weight of the total composition. The adhesives may also include a plasticizer component in an amount less than about 20% by weight of the total composition.

These adhesives are particularly well-suited for sealing the ring around the primer cup by UV cure and the primer cup in the cartridge by anaerobic cure in center fire ammunition. The ring seal assists in preventing the ingress of moisture into the primer cup in which is disposed a lead-free primer.

The (meth)acrylates that may be used in the adhesive composition in accordance with this invention include a wide variety of materials represented by $H_2C{=}CGCO_2R$, where G may be hydrogen, halogen or alkyl of 1 to about 4 carbon atoms, and R may be selected from alkyl, cycloalkyl, alkenyl, cycloalkenyl, alkaryl, aralkyl or aryl groups of 1 to about 16 carbon atoms.

More specific (meth)acrylates particularly desirable for use herein include polyethylene glycol di(meth)acrylates, bisphenol-A di(meth)acrylates, such as ethoxylated bisphenol-A (meth)acrylate ("EBIPMA") and tetrahydrofurane (meth)acrylates and di(meth)acrylates, isobornyl acrylate, hydroxypropyl (meth)acrylate, and hexanediol di(meth)acrylate. Of course, combinations of these (meth) acrylates may also be used.

The (meth)acrylate component will form the basis of the adhesive composition. That is, the composition may be comprised of greater than about 60% by weight of (meth) acrylate, such as about greater than about 65% by weight, desirably within the range of about 70% to about 75% by weight.

The adhesives are rendered curable anaerobically by including an anaerobic cure-inducing composition in the formulation. The formulation is applied to a substrate that is then placed in an environment in which air is excluded, such as the primer cup when placed in the cartridge.

Such an anaerobic cure-inducing composition useful in the present invention includes a variety of components, such as amines (including amine oxides, sulfonamides and triazines). A desirable composition to induce cure in accordance with the present invention includes saccharin, toluidenes, such as N,N-diethyl-p-toluidene and N,N-dimethyl-o-toluidene, acetyl phenylhydrazine, and maleic acid. Of course, other materials known to induce anaerobic cure may also be included or substituted therefor. See e.g., Loctite U.S. Pat. No. 3,218,305 (Krieble), U.S. Pat. No. 4,180,640 (Melody), U.S. Pat. No. 4,287,330 (Rich) and U.S. Pat. No. 4,321,349 (Rich). Quinones, such as napthoquinone and anthraquinone, may also be included to scavenge free radicals which form.

The anaerobic cure-inducing composition should be used in an amount up to about 10% by weight of the total composition, such as in the range of about 6% to about 8% by weight.

A photoinitator component is also included in the adhesive compositions of the present invention. For instance, those available commercially from Ciba-Geigy Corp., Tarrytown, N.Y. under the "IRGACURE" and "DAROCUR" tradenames are desirable, specifically "IRGACURE" 184 (1-hydroxycyclohexyl phenyl ketone), 907 (2-methyl-1-[4-(methylthio)phenyl]-2-morpholino propan-1-one), 369 (2-benzyl-2-N,N-dimethylamino-1-(4-morpholinophenyl)-1-butanone), 500 (the combination of 1-hydroxy cyclohexyl phenyl ketone and benzophenone), 651 (2,2-dimethoxy-2-phenyl acetophenone), 1700 (the combination of bis(2,6-dimethoxybenzoyl-2,4,4-trimethyl pentyl phosphine oxide and 2-hydroxy-2-methyl-1-phenyl-propan-1-one) and "DAROCUR" 1173 (2-hydroxy-2-methyl-1-phenyl-1-propane) and 4265 (the combination of 2,4,6-trimethylbenzoyldiphenyl-phosphine oxide and 2-hydroxy 2-methyl-1-phenyl-propan-1-one). Of course, combinations of these materials may also be employed herein.

The photoinitiator may be used in an amount of from about 0.5 to about 10% by weight of the total composition, such as about 4 to about 6% by weight.

The compositions may also include a plasticizer to aid in providing flexibility to the adhesive joint formed when the adhesive is cured. Ordinarily, the plasticizer should be used in an amount less than about 20% by weight of the total composition, such as about 5% to about 20% by weight, when used. A particularly desirable plasticizer is a non-reactive plasticizer, such as the polyester glycol, tetraethylene glycol di-2-ethyl hexoate.

Of course, other plasticizers may also be used such as those set forth in U.S. Pat. No. 3,794,610 (Bachmann), the disclosure of which is hereby expressly incorporated herein by reference.

Another particularly desirable plasticizer for use herein is a polymeric plasticizer, such as one available commercially under the tradename "UNIFLEX" 300 from Unicamp Corporation, Jacksonville, Fla. "UNIFLEX" 300 is a medium molecular weight polymeric plasticizer (made from hexanedioic acid and polymer with 1,4-butane diol and 1,2-propane diol), which is liquid at 25° C. whose viscosity at that temperature is 3300 cps. This polymeric plasticizer is reported to be resistant to high temperatures.

The compositions may also include a fluorescent dye to allow the user to determine the location of the adhesive on the ammunition.

Desirably, the adhesive in the uncured state should have a viscosity that is low enough to permit penetration in the ring or primer cup/primer pocket interface—i.e., the juncture between the primer cup and the primer pocket (see FIGS. 1 and 2)—so that surface cure around the sealing area can occur, thereby insuring the formation of a proper seal. In addition, the adhesive in the cured state should be flexible/tough so as to absorb trigger impact and provide good adhesive properties to hold/retain adhesive residue on the cartridge/primer cup interface rather than separating and clogging the gun barrel.

The invention also provides a process for making such compositions, a step of which includes combining in an open vessel in the substantial absence of radiation in the UV region of the electromagnetic spectrum the components of the composition.

Figure 2:
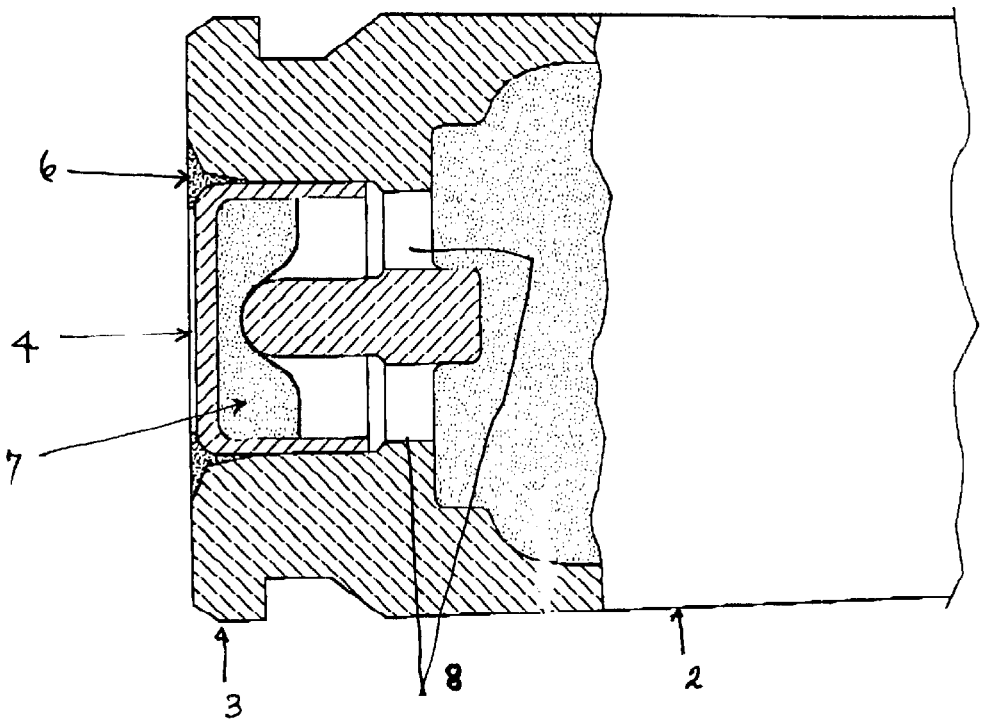
FIG. 2 depicts a partial cross sectional view of FIG. 1.

Reference to FIG. 1 shows the components of a single ammunition. The bullet 1 forms the front end of the ammunition, being attached to the cartridge case 2. The cartridge case 3 forms the back end of the ammunition, which is a primer pocket 5 dimensional and disposed to receive a primer cup 4. Within the primer cup/primer pocket interface is disposed primer, shown as 7 in FIG. 2. Reference again to FIG. 2 shows primer vent holes 8. Shown as 6 is the composition of the present invention.

The invention further includes a process for assembling ammunition, the steps of which include providing at least a partially assembled ammunition, one end of which having a pocket dimensioned and disposed to receive a primer cup; providing a primer cup dimensioned and disposed to be received by the primer pocket of the partially assembled ammunition, inserting the primer cup into the primer pocket; applying the composition to and about a juncture formed by the primer cup/primer pocket interface; and exposing the composition to UV radiation sufficient to initiate cure.

Appropriate sources of UV radiation include a fustion lamp, equipped with a "H" bulb, which emits a UV-A radiation dose of 1–4 J/cm$^2$.

EXAMPLES

The following adhesives were prepared with the noted components in the amounts recited:

| Sample No. | Component | Amount |
|---|---|---|
| 1 | polyethylene glycol dimethacrylate | 66% |
| | isobornyl acrylate | 18% |
| | hydroxy propyl methacrylate | 2% |
| | anaerobic cure-inducing composition | 8% |
| | "DAROCURE" 4265 | 6% |
| 2 | polyethylene glycol dimethacrylate | 60% |
| | isobornyl acrylate | 18% |
| | hydroxy propyl methacrylate | 2% |
| | ethoxylated bisphenol A dimethacrylate | 2% |
| | polyester glycol | 5% |
| | anaerobic cure-inducing composition | 7% |
| | "DAROCURE" 4265 | 6% |
| 3 | polyethylene glycol dimethacrylate | 60% |
| | isobornyl acrylate | 18% |
| | hydroxy propyl methacrylate | 2% |
| | ethoxylated bisphenol A dimethacrylate | 3% |
| | polyester glycol | 5% |
| | anaerobic cure-inducing composition | 7% |
| | "DAROCURE" 4265 | 5.8% |
| | fluoroscent dye | 0.2% |

Sample No. 3, when applied around the primer cup and cured initially by exposure to UV light and then under anaerobic conditions, was then evaluated in its intended commercial application. That is, five hundred rounds of ammunition sealed with this adhesive were fired from a gun and ring separation on the spent cartridges were determined. Only about 5 to 7 rounds showed an entire ring separation and only about 3 to 4 rounds showed a broken ring separation.

| Sample No. | Component | Amount |
|---|---|---|
| 4 | polyethylene glycol dimethacrylate | 64% |
| | ethoxylated bisphenol-A dimethacrylate | 2% |
| | isobornyl acrylate | 18% |
| | hydroxy propyl methacrylate | 2% |
| | anaerobic cure-inducing composition | 8% |
| | "DAROCURE" 4265 | 6% |
| 5 | polyethylene glycol dimethacrylate | 59% |
| | ethoxylated bisphenol-A (meth)acrylate | 2% |
| | isobornyl acrylate | 18% |
| | hydroxy propyl methacrylate | 2% |
| | tetraethylene glycol di-2-ethyl hexoate | 5% |
| | anaerobic cure-inducing composition | 8% |
| | "DAROCURE" 4265 | 6% |
| 6 | polyethylene glycol dimethacrylate | 59% |
| | ethoxylated bisphenol A dimethacrylate | 2% |
| | isobornyl acrylate | 9% |
| | hydroxy propyl methacrylate | 2% |
| | tetrathylene glycol di-2-ethyl hexoate | 15% |
| | anaerobic cure-inducing composition | 8% |
| | "DAROCURE" 4265 | 6% |
| 7 | polyethylene glycol dimethacrylate | 53% |
| | tetrathylene glycol di-2-ethyl hexoate | 15% |
| | anaerobic cure-inducing composition | 8% |
| | "IRGACURE" 184 | 4% |

In order to determine the degree of ring separation, ammunition assembled or described herein with aluminum cases and with the inventive compositions adhering and sealing the primer cup/reactant interface were fired from SIG 220/Kimbler and SIG 220/Glock 21 pistols. Five hundred rounds were fired from each pistol with each formulation. The ring separation upon firing the ammunition was observed by retrieving the spent cartridges.

Ammunition assembled with Sample No. 4 ring separated in 200–220 of the 500 rounds fired.

Ammunition assembled with Sample No. 5 ring separated in 5–7 of the 500 rounds fired.

Ammunition assembled with Sample No. 6 ring separated in 5–6 of the 500 rounds fired.

Ammunition assembled with Sample No. 7 ring separated in 160–180 of the 500 rounds fired.

The true scope of the invention is measured by the claims.

What is claimed is:

1. A radiation and anaerobically curable composition for sealing a primer cup/primer interface in center fire ammunition, comprising:

a. (meth)acrylate component, at least a portion of which includes a monofunctional (meth)acrylate;

b. an anaerobic cure-inducing component;

c. a photoinitator component; and d. a placticizer component in an amount less than about 20% by weight of the total composition.

2. The composition of claim 1, wherein the monofunctional (meth)acrylate is present in an amount in the range of about 10 to about 25% by weight of the total composition.

3. The composition of claim 1, wherein the (meth)acrylate represented by $H_2C{=}CGCO_2R$, wherein G may be hydrogen, halogen or alkyl of 1 to about 4 carbon atoms, and R may be selected from alkyl, cycloalkyl, alkenyl, cycloalkenyl, alkaryl, aralkyl or aryl groups of 1 to about 16 carbon atoms.

4. The composition of claim 1, wherein the (meth)acrylate is selected from the group consisting of polyethylene glycol di(meth)acrylates, bisphenol-A di(meth)acrylates, isobornyl acrylate, hydroxypropyl (meth)acrylate, hexanediol di(meth)acrylate, and combinations thereof.

5. The composition of claim 1, wherein the anaerobic cure-inducing composition includes saccharin, toluidenes, acetyl phenylhydrazine, and maleic acid.

6. The composition of claim 1, wherein the anaerobic cure-inducing composition should be used in an amount up to about 10% by weight of the total composition.

7. The composition of claim 1, wherein the photoinitator component is selected from the group consisting of 1-hydroxycyclohexyl phenyl ketone, 2-methyl-1-[4-(methylthio)phenyl]-2-morpholino propan-1-one), 2-benzyl-2-N,N-dimethylamino -1-(4-morpholinophenyl)-1-butanone, benzophenone, 2,2-dimethoxy-2-phenyl acetophenone, bis(2,6-dimethoxybenzoyl-2,4,4-trimethyl pentyl phosphine oxide, 2-hydroxy-2-methyl-1-phenyl-propan-1-one, 2,4,6-trimethylbenzoyldiphenyl-phosphine oxide and 2-hydroxy 2-methyl-1-phenyl-propan-1-one, and combinations thereof.

8. A process for making the composition of claim 1, a step of which includes:

a. combining in an open vessel in the substantial absence of radiation in the UV region of the electromagnetic spectrum the components (a)–(d).

9. A process for assembling ammunition, the steps of which comprise:

a. providing at least a partially assembled cartridge, one end of which having a pocket dimensioned and disposed to receive a primer cup;

b. providing a primer cup dimensioned and disposed to be received by said pocket of said partially assembled cartridge;

c. inserting said primer cup into said pocket;

d. applying a radiation and anaerobically curable composition comprising a (meth)acrylate component, at least a portion of which includes a monofunctional (meth) acrylate; an anaerobic cure-inducing component; a photoinitator component; and a placticizer component in an amount less than about 20% by weight of the total composition to and about a juncture formed by the primer cup/pocket interface;

e. exposing the composition to UV radiation sufficient to initiate cure; and f. permitting the composition in and about the primer cup/pocket interface juncture to cure under anaerobic conditions.

10. Ammunition comprising:

a bullet forming the front end of the ammunition, to which the bullet is attached to a cartridge casing; a cartridge case forming the back end of the ammunition, in which is a primer pocket dimensioned and disposed to receive a primer cup;

a primer cup dimensioned and disposed to be received by the primer pocket, thereby forming a primer cup/primer interface; and an adhesive composition of claim 1 dispensed in and about the primer cup/primer interface.

11. The process of claim 9, wherein the monofunctional (meth)acrylate is present in an amount in the range of about 10 to about 25% by weight of the total composition.

12. The process of claim 9, wherein the (meth)acrylate component is represented by $H_2C{=}CGCO_2R$, wherein G may be hydrogen, halogen or alkyl of 1 to about 4 carbon atoms, and R may be selected from alkyl, cycloalkyl, alkenyl, cycloalkenyl, alkaryl, aralkyl or aryl groups of 1 to about 16 carbon atoms.

13. The process of claim 9, wherein the (meth)acrylate component is a member selected from the group consisting of polyethylene glycol di(meth)acrylates, bisphenol-A di(meth)acrylates, isobornyl acrylate, hydroxypropyl (meth) acrylate, hexanediol di(meth)acrylate, and combinations thereof.

14. The process of claim 9, wherein the anaerobic cure-inducing composition includes saccharin, toluidenes, acetyl phenylhydrazine, and maleic acid.

15. The process of claim 9, wherein the anaerobic cure-inducing composition is used in an amount up to about 10% by weight of the total composition.

16. The process of claim 9, wherein the photoinitiator component is a member selected from the group consisting of 1-hydroxycyclohexyl phenyl ketone, 2-methyl-1-[4-(methylthio)phenyl]-2-morpholino propan-1-one, 2-benzyl-2-N,N-dimethylamino -1-(4-morpholinophenyl)-1-butanone, benzophenone, 2,2-dimethoxy-2-phenyl acetophenone, bis(2,6-dimethoxybenzoyl-2,4,4-trimethyl pentyl) phosphine oxide, 2-hydroxy-2-methyl-1-phenyl -propan-1-one, 2,4,6-trimethylbenzoyldiphenyl-phosphine oxide, 2-hydroxy 2-methyl-1-phenyl-propan-1-one), and combinations thereof.

* * * * *